US011495183B2

(12) United States Patent
Rao et al.

(10) Patent No.: US 11,495,183 B2
(45) Date of Patent: Nov. 8, 2022

(54) METHOD AND DEVICE FOR CONTROLLING BACKLIGHT BRIGHTNESS, AND DISPLAY DEVICE

(71) Applicant: BOE Technology Group Co., Ltd., Beijing (CN)

(72) Inventors: Tianmin Rao, Beijing (CN); Congrui Wu, Beijing (CN); Xitong Ma, Beijing (CN)

(73) Assignee: BEIJING BDE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/331,922

(22) Filed: May 27, 2021

(65) Prior Publication Data

US 2021/0375221 A1 Dec. 2, 2021

(30) Foreign Application Priority Data

May 29, 2020 (CN) ..... 202010476140.1

(51) Int. Cl.
*G09G 3/34* (2006.01)

(52) U.S. Cl.
CPC ..... *G09G 3/3426* (2013.01); *G09G 2310/08* (2013.01); *G09G 2320/0646* (2013.01)

(58) Field of Classification Search
CPC ..... G09G 3/3426; G09G 2310/08; G09G 2320/0646
See application file for complete search history.

(56) References Cited

U.S. PATENT DOCUMENTS

2009/0003697 A1* 1/2009 Lee ..... G06T 5/009 382/167
2009/0201320 A1 8/2009 Damberg et al.
(Continued)

FOREIGN PATENT DOCUMENTS

CN 101281732 A 10/2008
CN 102007528 A 4/2011
(Continued)

OTHER PUBLICATIONS

Blur-Mask Approach for Real-Time Calculation of Light Spreading Function (LSF) on Spatial Modulated High Dynamic Range LCDs.
(Continued)

*Primary Examiner* — Towfiq Elahi
(74) *Attorney, Agent, or Firm* — IPro, PLLC

(57) ABSTRACT

A method of controlling backlight brightness, applicable to a display device including a backlight module having a plurality of dimming zones, includes: determining a target image display mode; determining a target filter core according to the target image display mode; obtaining initial backlight control data by acquiring initial backlight control values of respective dimming zones according to image data of respective image segments of a first image, wherein the respective image segments correspond to the respective dimming zones in a one-to-one correspondence; obtaining target backlight control data by performing smoothing-filtering on the initial backlight control data with the target filter core, wherein the target backlight control data comprises respective target backlight control values of the plurality of dimming zones; and controlling backlight brightness of the respective dimming zones according to the respective target backlight control values. A backlight brightness control device and a display device are further provided.

19 Claims, 8 Drawing Sheets

(56) References Cited

U.S. PATENT DOCUMENTS

| | | | | |
|---|---|---|---|---|
| 2011/0148941 | A1 | 6/2011 | Kim et al. | |
| 2011/0292018 | A1 | 12/2011 | Kubota et al. | |
| 2012/0133685 | A1 | 5/2012 | Cho et al. | |
| 2018/0075813 | A1* | 3/2018 | Zhang | G09G 3/34 |
| 2018/0293932 | A1 | 10/2018 | Duan | |
| 2019/0311672 | A1* | 10/2019 | Jeong | G09G 3/32 |
| 2020/0064688 | A1 | 2/2020 | Lin | |
| 2020/0066214 | A1 | 2/2020 | Lin et al. | |

FOREIGN PATENT DOCUMENTS

| | | | |
|---|---|---|---|
| CN | 102103840 | A | 6/2011 |
| CN | 102262866 | A | 11/2011 |
| CN | 102479496 | A | 5/2012 |
| CN | 102930831 | A | 2/2013 |
| CN | 105867867 | A | 8/2016 |
| CN | 106328071 | A | 1/2017 |
| JP | 2012237903 | A | 12/2012 |

OTHER PUBLICATIONS

Dynamic dimming algorithm with twice-correction of LED backlit based on average.
Light Spread in Local-dimming LED-backlight.
Research on Local Dimming Algorithm Based on HDR Display.
X1922091JZ—Search Report.
CN202010476140.1 First Office Action.

* cited by examiner

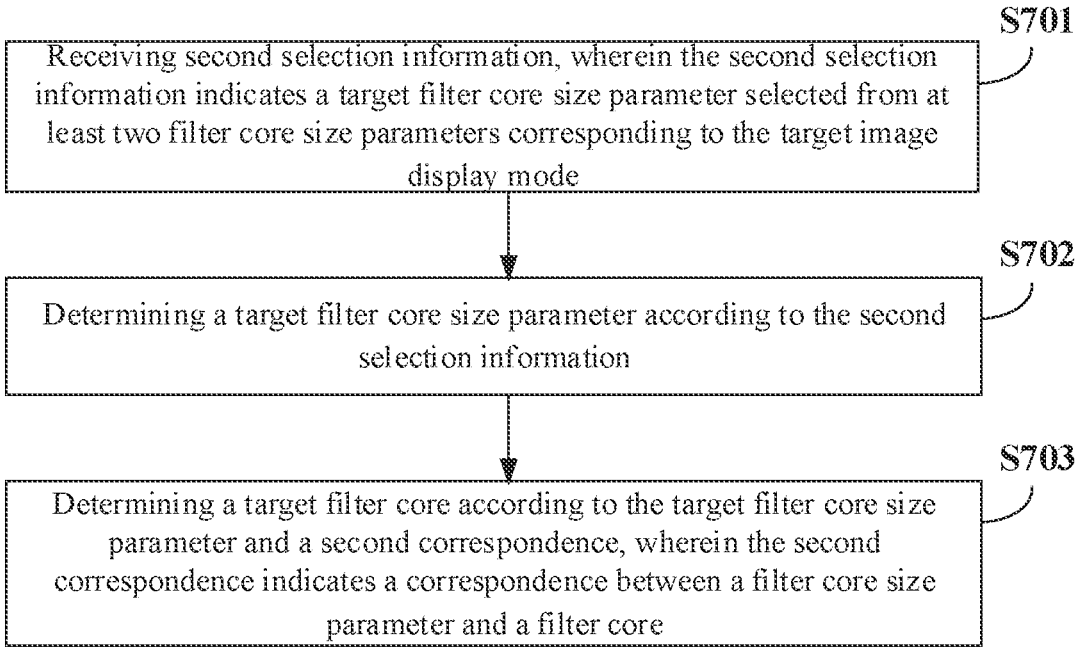
FIG. 7
| | | | | |
|---|---|---|---|---|
| Data1 | Data2 | Data3 | Data4 | Data5 |
| Data6 | Data7 | Data8 | Data9 | Data10 |
| Data11 | Data12 | Data0 | Data13 | Data14 |
| Data15 | Data16 | Data17 | Data18 | Data19 |
| Data20 | Data21 | Data22 | Data23 | Data24 |
FIG. 8
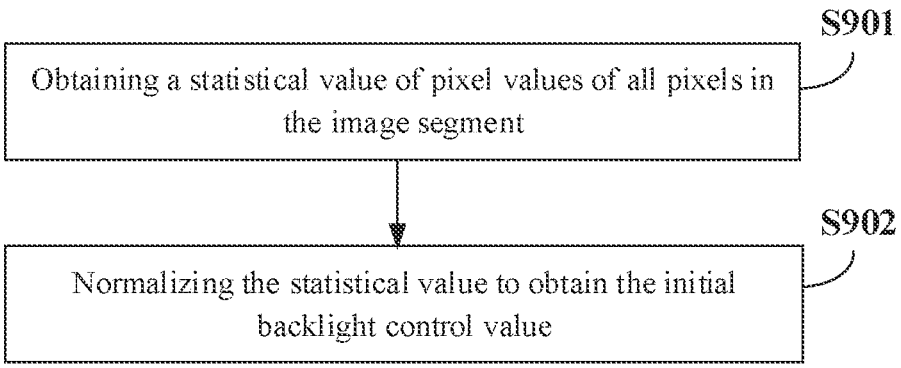
FIG. 9

| | | | | |
|---|---|---|---|---|
| D11 | D12 | D13 | ... | D1m |
| D21 | D22 | D23 | ... | D2m |
| D31 | D32 | D33 | ... | D3m |
| ... | ... | ... | ... | ... |
| Dn1 | Dn2 | Dn3 | ... | Dnm |

| | | | | | | | | | | | | | | | | | | | | |
|---|---|---|---|---|---|---|---|---|---|---|---|---|---|---|---|---|---|---|---|---|
| D11 | D12 | D13 | ... | D1m | D21 | D22 | D23 | ... | D2m | D31 | D32 | D33 | ... | D3m | ... | Dn1 | Dn2 | Dn3 | ... | Dnm |

| | |
|---|---|
| Data0 | Data1 |
| Data2 | Data3 |
FIG. 13
| | | | | |
|---|---|---|---|---|
| d11 | d12 | d13 | ... | d1m |
| d21 | d22 | d23 | ... | d2m |
| d31 | d32 | d33 | ... | d3m |
| ... | ... | ... | ... | ... |
| dn1 | dn2 | dn3 | ... | dnm |
FIG. 14
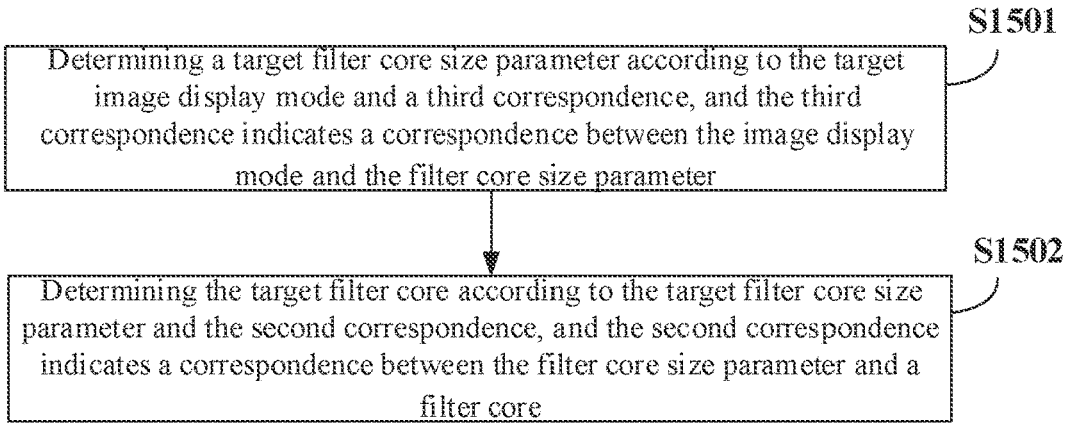
FIG. 15
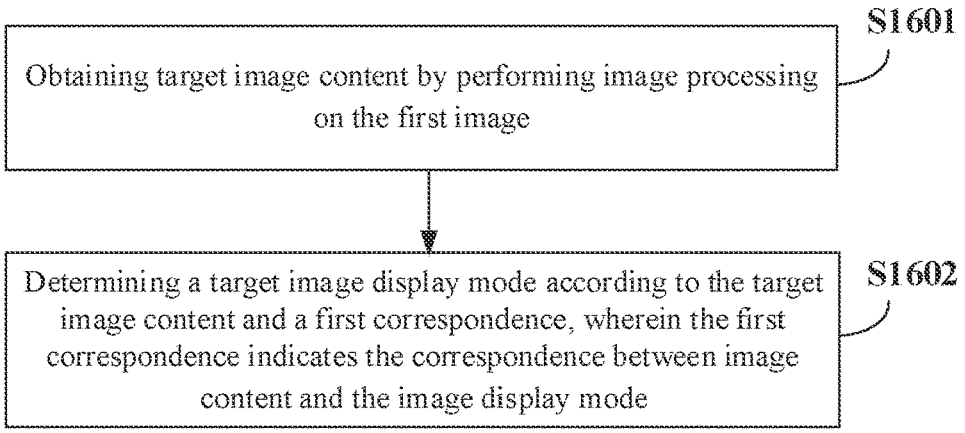
FIG. 16

METHOD AND DEVICE FOR CONTROLLING BACKLIGHT BRIGHTNESS, AND DISPLAY DEVICE

CROSS REFERENCE TO RELATED APPLICATIONS

The present application claims priority to a Chinese patent application under CN 202010476140.1, entitled "DISPLAY DEVICE, AND METHOD AND DEVICE FOR CONTROLLING BACKLIGHT BRIGHTNESS THEREOF" and filed with China National Intellectual Property Administration (CNIPA) on May 29, 2020, the content of which is incorporated herein by reference in its entirety for all purposes.

TECHNICAL FIELD

Embodiments of the present disclosure relate to a method and a device for controlling backlight brightness, and a display device.

BACKGROUND

In related arts, mini LEDs (small light emitting diodes) may be used as a backlight source in LCD (Liquid Crystal Display, liquid crystal display) systems. LCDs can adopt a uniform global backlight or a global backlight control to perform uniform backlight processing for a display screen. However, due to light leakage in the LCDs, dark or black background display is not pure enough, and the effect of pure black cannot be achieved, and contrast of the overall picture is relatively low. In order to solve the problem of light leakage in LCD displays, local dimming technology based on multi-zones mini LEDs is attracting more and more attention. In order to improve the display effect of the LCDs, the local dimming technology may be adopted. According to different bright and dark scenes in a screen, different local zones of the backlight may be adjusted independently. Backlight brightness in a bright image area may be increased and backlight brightness in a dark image area may be reduced. As a result, the dark area of the screen is getting darker and is close to pure black, the bright area of the screen is getting brighter. So, the display of pure colors is more vivid, and a relatively high contrast effect is achieved.

In arts known by the inventors, in a case that the number of local zones of the backlight is not great enough, uneven brightness of the backlight occurs. Backlights of the local zones are filtered so as to make backlight distribution in various local zones more uniform. However, there is still uneven backlight distribution or heavier halo near objects in the displayed screen.

SUMMARY

At least one embodiment of the present disclosure provides a backlight brightness control method, which is applicable to a display device which includes a backlight module having a plurality of dimming zones, and the method includes:

determining a target image display mode;

determining a target filter core according to the target image display mode;

obtaining initial backlight control data by acquiring initial backlight control values of respective dimming zones according to image data of respective image segments of a first image, wherein the respective image segments correspond to the respective dimming zones in a one-to-one correspondence;

obtaining target backlight control data by performing smoothing-filtering on the initial backlight control data with the target filter core, wherein the target backlight control data includes respective target backlight control values of the plurality of dimming zones; and controlling backlight brightness of the plurality of dimming zones according to the respective target backlight control values.

In an embodiment of the present disclosure, determining the target image display mode includes: receiving first selection information which indicates a target image display mode selected from at least two image display modes; and determining the target image display mode according to the first selection information.

In an embodiment of the present disclosure, determining the target image display mode includes: obtaining target image content by performing image recognition on the first image; and determining the target image display mode according to the target image content and a first correspondence, wherein the first correspondence indicates a correspondence between image content and an image display mode.

In an embodiment of the present disclosure, determining the corresponding target filter core according to the target image display mode includes: receiving second selection information, wherein the second selection information indicates a target filter core size parameter selected from at least two filter core size parameter corresponding to the target image display mode; determining the target filter core size parameter according to the second selection information; and determine the target filter core according to the target filter core size parameter and a second correspondence, wherein the second correspondence indicates a correspondence between the filter core size parameter and the filter core.

In an embodiment of the present disclosure, determining the corresponding target filter core according to the target image display mode includes: determining the target filter core size parameter according to the target image display mode and a third correspondence, wherein the third correspondence indicates a correspondence between an image display mode and a filter core size parameter; and determining the target filter core according to the target filter core size parameter and a second correspondence, wherein the second correspondence indicates a correspondence between the filter core size parameter and a filter core.

In an embodiment of the present disclosure, obtaining the initial backlight control data by acquiring the initial backlight control values of the respective dimming zones according to the image data of the respective image segments of the first image includes: for each of the image segments, acquiring a statistical value of the pixel values of all pixels in the image segment; and normalizing the statistical value to obtain the initial backlight control value.

In an embodiment of the present disclosure, after obtaining the initial backlight control data by acquiring the initial backlight control values of the respective dimming zones according to the image data of the respective image segments of the first image, the method further includes: storing the initial backlight control data in memory, and obtaining the target backlight control data by performing smoothing-filtering on the initial backlight control data with the target filter core includes: for each smoothing-filtering, determine a first data storage address in the memory of the initial backlight control value located at an anchor point in a window of the target filter core; determining respective second data storage addresses of remaining initial backlight control values in the window of the target filter core according to the target filter core size parameter and the first data storage address; determining a read timing according to the first data storage address and the respective second data storage addresses; reading the initial backlight control value in the window of the target filter core from the memory according to the read timing so as to obtain window data; and obtaining the target backlight control values by performing smoothing-filtering on the window data with the target filter core.

In an embodiment of the present disclosure, the target filter core size parameter is an odd number; the anchor point is a center point of the window; the plurality of dimming zones includes n rows and m columns of dimming zones, the initial backlight control data includes an initial backlight control value array of n rows and m columns; the respective second data storage addresses in the target filter core window of the remaining initial backlight control values are determined according to following equation and according to the target filter core size parameter and the first data storage address:

$$r_addr_window = r_addr_base + j + step * i$$

wherein, the r_addr_window indicates the second data storage address, the r_addr_base indicates the first data storage address, the i indicates a row flag of the initial backlight control value array, and the j indicates a column flag of the initial backlight control value array, the step indicates the number of initial backlight control values in each row in the initial backlight control value array, and a value range of the i is $[-(w-1)/2, (w-1)/2]$, a value range of the j is $[-(w-1)/2, (w-1)/2]$, and the w indicates the target filter core size parameter.

In an embodiment of the present disclosure, the target filter core size parameter is an even number; the anchor point is a start point of the window; and the plurality of dimming zones includes dimming zones of n rows and m columns, the initial backlight control data includes an initial backlight control value array of n rows and m columns; determining respective second data storage addresses in the target filter core window of the remaining initial backlight control values according to following equation and according to the target filter core size parameter and the first data storage address:

$$r_addr_window = r_addr_base + j + step * i$$

wherein, the r_addr_window indicates the second data storage address, the r_addr_base indicates the first data storage address, the i indicates a row flag of the initial backlight control value array, and the j indicates a column flag of the initial backlight control value array, the step indicates the number of initial backlight control values in each row in the initial backlight control value array, a value range of the i is $[0, w-1]$, a value range of the j is $[0, w-1]$, and the w indicates the target filter core size parameter.

In an embodiment of the present disclosure, before obtaining the target backlight control data by performing smoothing-filtering on the initial backlight control data with the target filter core, the method further includes: detecting a start flag of a second image, wherein the first image and the second image are two adjacent images in a same video, and the first image is displayed before the second image.

At least one embodiment of the present disclosure provides a backlight brightness control device suitable for a display device, the display device including a backlight module, the backlight module including a plurality of dimming zones, wherein the backlight brightness control device includes a processing chip and a driving chip;

the processing chip is configured to: determine a target image display mode; determine a target filter core according to the target image display mode; obtain initial backlight control data by acquiring initial backlight control values of respective dimming zone according to image data of respective image segments of a first image, wherein the respective image segments correspond to the respective dimming zones in a one-to-one correspondence; obtain target backlight control data by performing smoothing-filtering on the initial backlight control data with the target filter core, wherein the target backlight control data comprises respective target backlight control values of the plurality of dimming zones; and the driving chip is configured to control the backlight brightness of the respective dimming zones according to the target backlight control values.

In an embodiment of the present disclosure, the processing chip includes an SoC chip configured to receive first selection information and to determine the target image display mode according to the first selection information, wherein the first selection information indicates a target image display mode selected from at least two image display modes.

In an embodiment of the present disclosure, the processing chip comprises a SoC chip configured to perform image recognition on the first image to obtain target image content, and to determine the target image display mode according to the target image content and a first correspondence, wherein the first correspondence indicates a correspondence between an image content and an image display mode.

In an embodiment of the present disclosure, the processing chip includes an SoC chip and an FPGA; the SoC chip is configured to receive second selection information and to determine a target filter core size parameter according to the second selection information, wherein the second selection information indicates a target filter core size parameter selected from at least two filter core size parameter corresponding to the target image display mode; and the FPGA is configured to determine the target filter core according to the target filter core size parameter and a second correspondence, wherein the second correspondence indicates a correspondence between a filter core size parameter and a filter core.

In an embodiment of the present disclosure, the processing chip comprises an SoC chip and an FPGA; the SoC chip is configured to determine a target filter core size parameter according to the target image display mode and a third correspondence, wherein the third correspondence indicates a correspondence between an image display mode and a filter core size parameter; and the FPGA is configured to determine the target filter core according to the target filter core size parameter and a second correspondence, wherein the second correspondence indicates a correspondence between the filter core size parameter and a filter core.

In an embodiment of the present disclosure, the processing chip includes an FPGA; the FPGA is configured to obtain, for each of the plurality of image segments, a statistical value of pixel values of all pixels in the image segment, and to obtain the initial backlight control values by normalizing the statistical value.

In an embodiment of the present disclosure, the processing chip comprises an FPGA; the FPGA comprises a memory; and the FPGA is configured to store the initial backlight control data in the memory; and for each smoothing-filtering, determine a first data storage address in the memory of the initial backlight control value located at an anchor point in the window of the target filter core; determine respective second data storage addresses of remaining initial backlight control values in the window of the target filter core according to the target filter core size parameter and the first data storage address; determine a read timing according to the first data storage address and the respective second data storage addresses; obtain window data by reading the initial backlight control value in the window of the target filter core from the memory according to the read timing; and obtain the target backlight control values by performing smoothing-filtering on the window data with the target filter core.

In an embodiment of the present disclosure, the processing chip is further configured to, before obtaining the target backlight control data by performing smoothing-filtering on the initial backlight control data with the target filter core, detect a start flag of a second image, wherein the first image and the second image are two adjacent images of a same video, and the first image is displayed before the second image.

At least one embodiment of the present disclosure provides a backlight brightness control device applicable to a display device, comprising: a processor and a storage medium, the storage medium configured to store computer instructions executable by the processor, wherein in response to that the computer instructions are executed by the processor, the processor is configured to implement operations of the method of controlling backlight brightness for the display device as described above.

At least one embodiment of the present disclosure provides a display device, comprising a backlight module and the backlight brightness control device of the display device as described above, wherein the backlight module comprises a plurality of dimming zones.

It should be understood that the above general description and the following detailed description are only exemplary and explanatory, and cannot be construed as a limit to the present disclosure.

BRIEF DESCRIPTION OF THE DRAWINGS

The figures herein are incorporated into the specification and constitute a part of the specification, illustrate embodiments consistent with the disclosure, and are used together with the specification to explain the principle of the disclosure.

FIG. 7 illustrates a flowchart of a method of controlling backlight brightness of a display device according to still another embodiment of the present disclosure;

FIG. 8 illustrates a schematic structural view of a filter core according to an embodiment of the present disclosure;

FIG. 9 illustrates a flowchart of a method of controlling backlight brightness of a display device according to another embodiment of the present disclosure;

FIG. 13 illustrates a schematic structural view of a filter core according to another embodiment of the present disclosure;

FIG. 14 illustrates a schematic diagram of target backlight control data according to an embodiment of the present disclosure;

FIG. 15 illustrates a flowchart of a method of controlling backlight brightness of a display device according to another embodiment of the present disclosure;

FIG. 16 illustrates a flowchart of a method of controlling backlight brightness of a display device according to another embodiment of the present disclosure;

DETAILED DESCRIPTION OF THE EMBODIMENTS

The exemplary embodiments will be described in detail hereinafter, and examples thereof are illustrated in the accompanying figures. When the following description refers to the figures, unless otherwise indicated, the same reference signs in different drawings indicate the same or similar elements. The implementation manners described in the following exemplary embodiments do not represent all implementation manners in consistence with the present disclosure. Rather, they are merely examples of devices and methods in consistence with some aspects of the present disclosure as defined in the appended claims.

Figure 1:
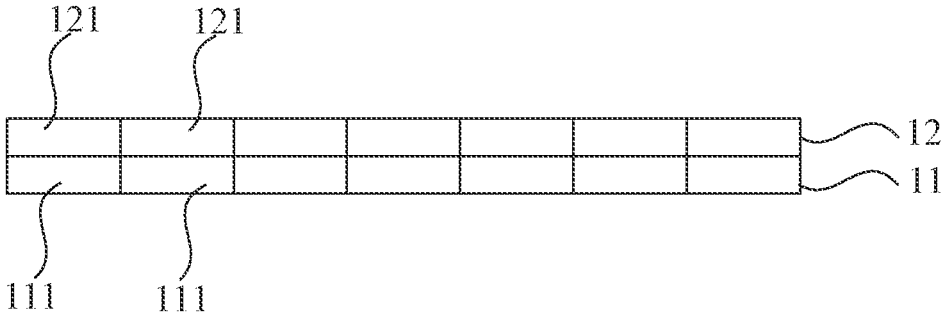
FIG. 1 shows a schematic structural view of a display device according to related arts.
Figure 2:
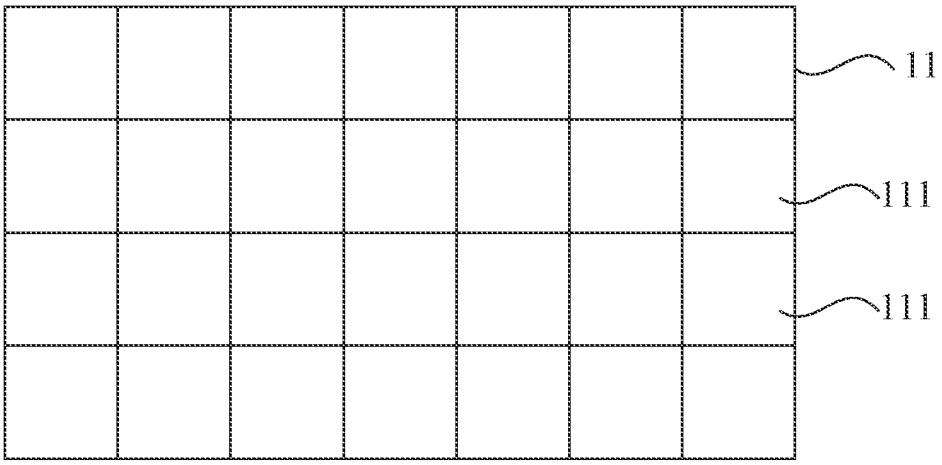
FIG. 2 shows a schematic structural view of a backlight module according to related arts.
Figure 3:
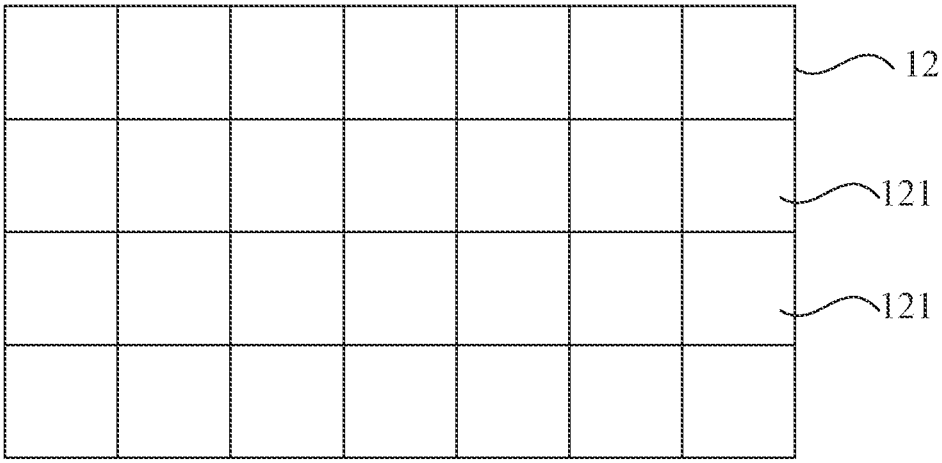
FIG. 3 shows a schematic structural view of a display panel according to related arts.

In the related art, as shown in FIG. 1, the display device includes a backlight module 11 and a display panel 12, and the backlight module 11 is configured to provide backlight to the display panel 12. As illustrated in FIGS. 1 to 3, the backlight module 11 includes a plurality of dimming zones 111, the display panel 12 includes a plurality of display segments 121, and the plurality of dimming zones 111 correspond to the plurality of display segments 121 in a one-to-one correspondence, and each dimming zone 111 is configured to provide backlight to a corresponding display segment 121. The image displayed on the display panel 12 also includes a plurality of image segments, and the plurality of image segments correspond to the plurality of display segments 121 in a one-to-one correspondence. Therefore, the plurality of image segments also correspond to the plurality of dimming zones 111 in a one-to-one correspondence.

In related arts of local dimming, a maximum, a mean, a median, or other operators of a dimming zone are used as a reference for backlight control. However, backlight intensity of different dimming zones lacks correlation, and uneven backlight brightness occurs in a case that the number of dimming zones is not great enough. Distribution of backlight intensity of various dimming zones may be made uniform by filtering backlight signal of the dimming zones. However, filtering is achieved by using a filter core with a fixed size, and it has various degrees of deficiencies for images of different scenes. In a scene with many small targets, a filter core with a relative great size aggravates halo effect near objects in the image, while in a scene with many large targets, a filter core with a relatively small size weakens smoothing-filtering effect between dimming zones. Therefore, in the related art, the distribution of backlight intensity is non-uniform or the halo effect near the objects in the image is relatively serious.

Embodiments of the present disclosure provide a display device and a method and a device of controlling backlight brightness, to avoid non-uniform distribution of backlight brightness or heavier halo near objects in the display screen, and to improve the display effect.

Figure 4:
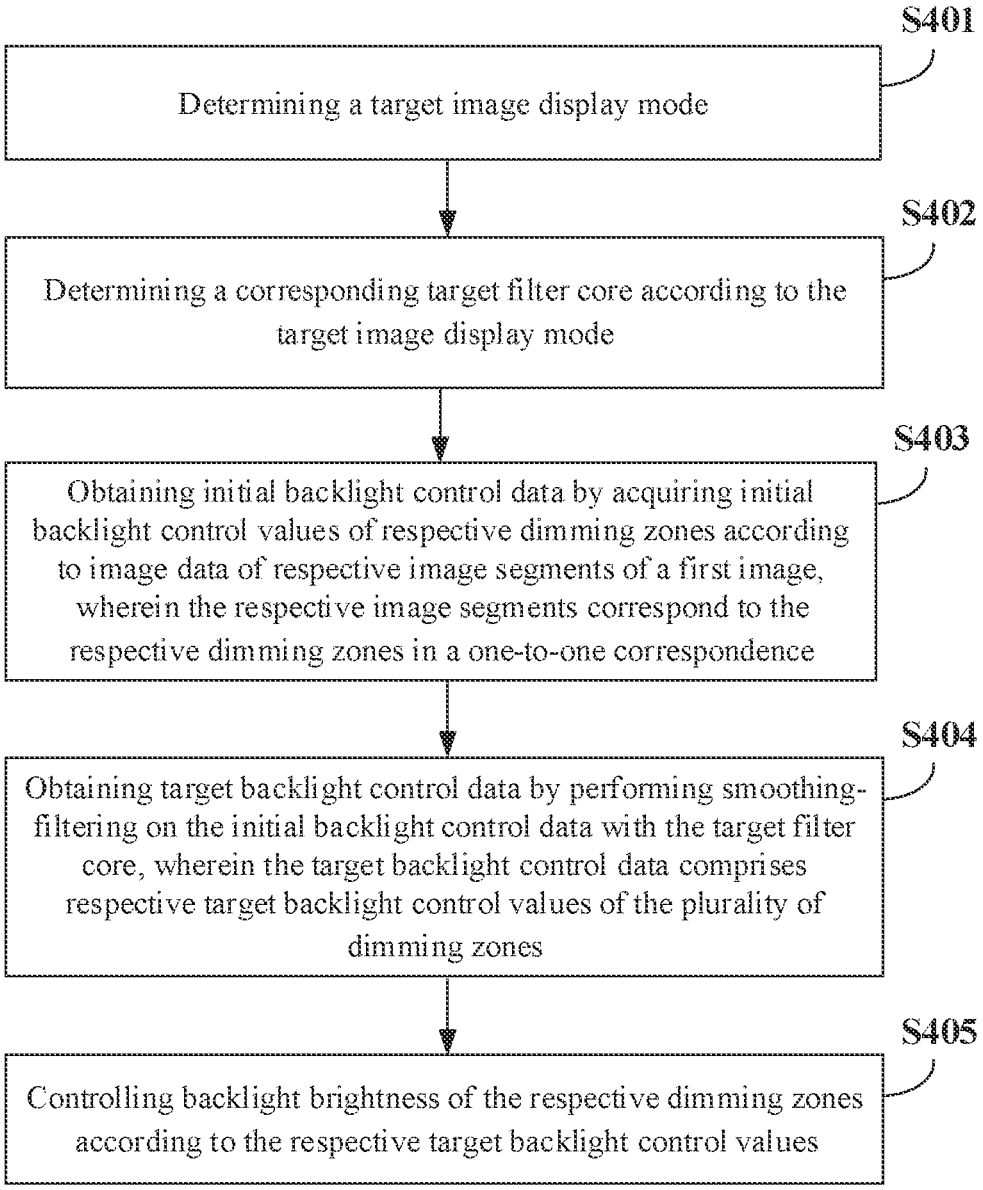
FIG. 4 illustrates a flowchart of a method of controlling backlight brightness of a display device according to an embodiment of the present disclosure.

At least one embodiment of the present disclosure provides a method of controlling backlight brightness for a display device. As shown in FIG. 1, the display device includes a backlight module 11 which includes a plurality of dimming zones 111. As illustrated in FIG. 4, a method of controlling backlight brightness for the display device includes following:

In step S401, a target image display mode is determined.

In step S402, a corresponding target filter core is determined according to the target image display mode.

In step S403, initial backlight control data is obtained by acquiring initial backlight control values of respective dimming zones according to image data of respective image segments of a first image, wherein the respective image segments correspond to the respective dimming zones in a one-to-one correspondence.

In step S404, target backlight control data is obtained by performing smoothing-filtering on the initial backlight control data with the target filter core, wherein the target backlight control data comprises respective target backlight control values of the plurality of dimming zones.

In step S405, backlight brightness of the respective dimming zones is controlled according to the respective target backlight control values.

In this embodiment of the present disclosure, by determining the target image display mode, determining the corresponding target filter core according to the target image display mode, and performing smoothing-filtering on the initial backlight control data with the target filter core, the target backlight control data can be obtained and the backlight brightness of the corresponding dimming zone can be controlled according to the target backlight control value. That is, the filter core that performing smoothing-filtering on the initial backlight control data can be controlled by determining the target image display mode, so that the target filter core can be selected according to actual situation of the image to be displayed, so as to avoid non-uniform backlight distribution or a relatively heavy halo near objects in the display screen, thereby improving the display effect.

The method of controlling backlight brightness for the display device according to the embodiments of the present disclosure is briefly discussed, and the following describes the method of controlling backlight brightness for the display device according to embodiments of the present disclosure in detail.

Figure 5:
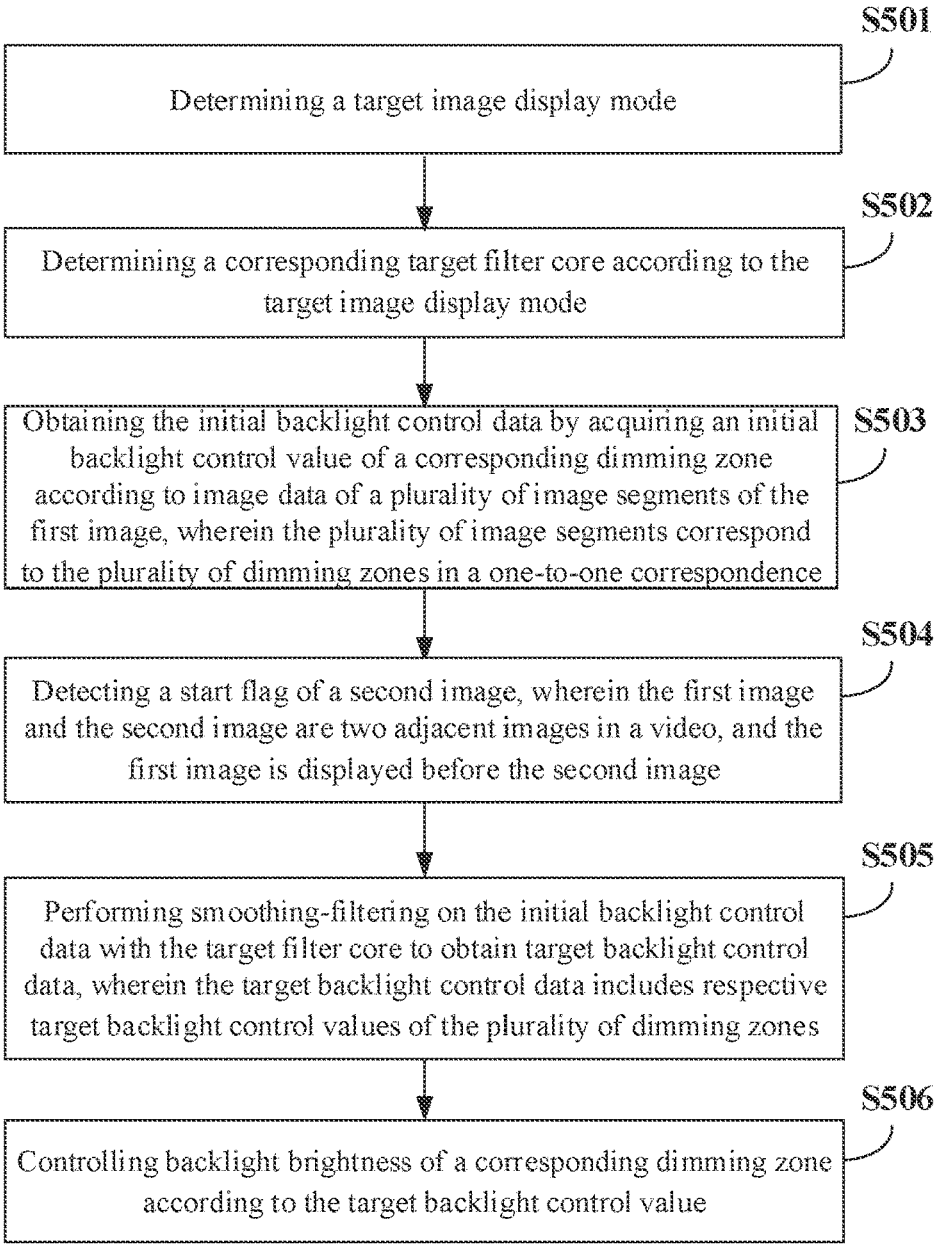
FIG. 5 illustrates a flowchart of a method of controlling backlight brightness of a display device according to another embodiment of the present disclosure.

An embodiment of the present disclosure provides a method of controlling backlight brightness for a display device. As illustrated in FIG. 5, the method of controlling backlight brightness for the display device includes the following steps S501 to S506:

In step S501, a target image display mode is determined.

In this embodiment, the method of controlling backlight brightness for the display device is described by taking that the display device plays video as an example. Of course, the method of controlling backlight brightness for the display device according to the embodiment of the present disclosure is further applicable to application scenarios where a single image is displayed for a long time, for example, a scene where a single photo is displayed, wherein a duration of displaying the single photo is relatively long, for example, longer than 30 seconds, which is not limited to this.

In an embodiment of the present disclosure, before the display device plays the video, the target image display mode is determined first. In this embodiment, the target image display mode may be a character mode, a landscape mode or a delicacy mode, which is not limited in the present disclosure.

Figure 6:
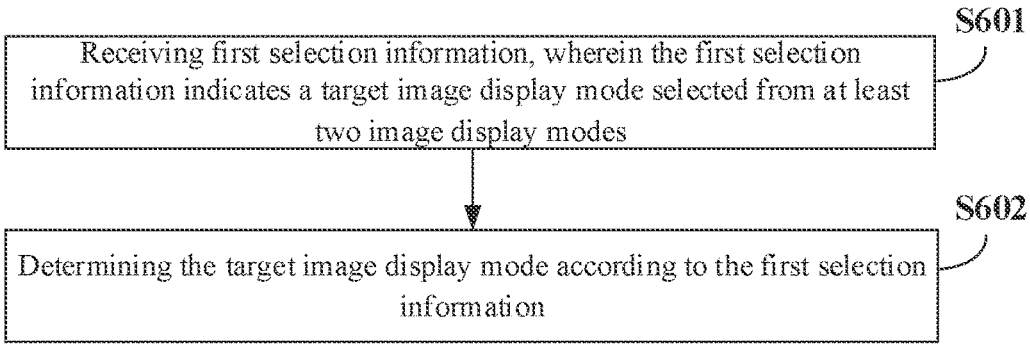
FIG. 6 illustrates a flowchart of a method of controlling backlight brightness of a display device according to another embodiment of the present disclosure.

In an embodiment of the present disclosure, the display device may provide a plurality of options of image display mode for the user to choose, and the display device may determine the target image display mode selected by the user according to the user's selection. As illustrated in FIG. 6, Step S501 may include the following steps S601 to S602:

In step S601, first selection information is received, wherein the first selection information indicates a target image display mode selected from at least two image display modes.

In an embodiment of the present disclosure, the display device may provide three image display modes: a character mode, a landscape mode, and a delicacy mode. In this embodiment, the display device being a touch screen display device is taken as an example for description. The display device can display three display mode options corresponding to the three image display modes on a display interface for the user to select. However, the image display mode that the display device can provide is not limited to the above-mentioned image display modes.

In an embodiment of the present disclosure, the display device may receive the first selection information input by the user through a touch screen. For example, in a case that the video played by the user contains characters, the user can select a display mode option corresponding to the character mode, and in response to the user's selection, the display device receives the first selection information that indicates the user's selection on the display mode. For example, the user can input the first selection information on the display mode option by clicking or touching an area where the display mode option corresponding to the character mode is displayed. The first selection information includes information of the image display mode selected by the user, that is, the first selection information may indicate a target image display mode selected from at least two image display modes.

In step S602, the target image display mode is determined according to the first selection information.

In an embodiment of the present disclosure, since the first selection information includes information of the target image display mode, the display device may determine the target image display mode according to the first selection information.

Of course, in actual application, the display device may further receive the first selection information on the display mode option in other ways, for example, the first selection information on the display mode option can be received through a mechanical button (such as a volume key, a power button) and a microphone, or any other manner.

In an embodiment of the present disclosure, the display device provides an interface for the user to select an image display mode, so that the user can select the target image display mode according to the image display requirements, which is beneficial to improve the user experience.

In step S502, a corresponding target filter core is determined according to the target image display mode.

In an embodiment of the present disclosure, each image display mode corresponds to at least two filter cores. Sizes of the at least two filter cores corresponding to one image display mode are different. For example, there are 3 filter cores for the character mode, and sizes of the 3 filter cores are 3*3, 4*4, 5*5, respectively; there are 3 filter cores for the landscape mode, and sizes of the 3 filter cores are 9*9, 15*15, 20*20, respectively; and there are 3 filter cores for the delicacy mode, and sizes of the 3 filter cores are 6*6, 7*7, 8*8, respectively, and the present disclosure are not limited thereto. Therefore, it is required to determine a target filter core corresponding to the target image display mode.

In this embodiment, as illustrated in FIG. 7, step S502 includes the following steps S701 to S703:

In step S701, second selection information is received, wherein the second selection information indicates a target filter core size parameter selected from at least two filter core size parameters corresponding to the target image display mode.

In step S702, a target filter core size parameter is determined according to the second selection information.

In step S703, a target filter core is determined according to the target filter core size parameter and a second correspondence, wherein the second correspondence indicates a correspondence between a filter core size parameter and a filter core.

In an embodiment of the present disclosure, after the display device determines the target image display mode, at least two filter core size parameters corresponding to the target image display mode may be displayed on the display interface for the user to select. The filter core size parameter includes information on the filter core size. For example, in a case that the filter core size parameter is 3, it is indicated that the filter core size is 3*3, and in a case that the filter core size parameter is 9, it is indicated that the filter core size is 9*9.

In an embodiment of the present disclosure, in a case that the target image display mode is the character mode, three filter core sizes corresponding to the character mode are displayed, that is, the filter core sizes 3*3, 4*4, and 5*5 corresponding to the character mode, that is, the filter core size parameters 3, 4, and 5 are displayed. The filter core size parameter corresponding to the filter core with a size of 3*3 is 3, the filter core size parameter corresponding to the filter core with a size of 4*4 is 4, and the filter core size parameter corresponding to the filter core with a size of 5*5 is 5.

In an embodiment of the present disclosure, the display device may receive the second selection information input by the user. For example, in a case that the user selects a filter core with a size of 3*3, the display device receives the second selection information that is input by the user and indicates that the filter core size is 3*3. For example, the user can input the second selection information indicating the selection of the filter core size by clicking or touching an area displaying the filter core size of 3*3. The second selection information includes information on the filter core size parameter selected by the user, that is, the second selection information may indicate the target filter core size parameter selected from at least two filter core size parameters corresponding to the target image display mode.

In an embodiment of the present disclosure, since the second selection information includes information on the target filter core size parameter, the display device can determine the target filter core size parameter according to the second selection information.

In an embodiment of the present disclosure, the display device provides an interface for the user to select the size of the filter core according to display requirements, which is beneficial to improve the display effect and thereby enhances the user experience.

In an embodiment of the present disclosure, the display device may pre-store the second correspondence and a filter core corresponding to respective filter core size parameters, and the display device may obtain a corresponding target filter core by looking up the second correspondence according to the target filter core size parameter. For example, in a case that the target filter core size parameter is 5, the target filter core may be a filter core of 5*5 as illustrated in FIG. 8, wherein Data0~Data24 are coefficients of the filter core. Values of Data0~Data24 are predetermined according to display requirements.

In addition, it should be noted that the filter core in the present disclosure may also be referred to as a filter, a template, a mask, or a window.

In step S503, the initial backlight control data may be obtained by acquiring an initial backlight control value of a corresponding dimming zone according to image data of a plurality of image segments of the first image, wherein the plurality of image segments correspond to the plurality of dimming zones in a one-to-one correspondence.

In an embodiment of the present disclosure, the backlight control value may be calculated according to image data of an image to be displayed. However, due to time required for calculation and time delay, it is very challenging to calculate the backlight control data used in a case of displaying a frame of image based on image data of the frame of image. In view of that image content of two adjacent frames of image in a video may be relatively similar, backlight control data calculated from image data of an image displayed earlier may be used to control backlight brightness for displaying an image that is displayed later. In this way, the display effect of most frames of image in the video can be improved. Even so, the backlight control value can still be adjusted in real time, so that brightness of respective dimming zones may be changed in real time with content of the display screen. It should be noted that in the application scenario of displaying a single image for a long time, backlight control data used in a case of displaying a frame of image can be calculated according to image data of the single image. In this way, backlight control data may be obtained more accurately, which is beneficial to improve the display effect.

In an embodiment of the present disclosure, one or more mini LEDs are included in a dimming zone. For example, a dimming zone includes four mini LEDs, and all the mini LEDs in the dimming zone may be controlled together. Therefore, a dimming zone may be controlled with a backlight control value. Furthermore, a dimming zone may correspond to a backlight control value, and the backlight control value includes information on driving current of the mini LEDs of the dimming zone.

In an embodiment of the present disclosure, the video includes a first image and a second image which are displayed in consecutive time, and the first image is displayed before the second image. For each image segment of the first image, initial backlight control values of a corresponding dimming zone may be obtained according to image data of the image segment. In an embodiment of the present disclosure, as illustrated in FIG. 9, step S503 includes the following steps S901 to S902:

In step S901, a statistical value of pixel values of all pixels in the image segment are obtained.

In step S902, the statistical value is normalized to obtain the initial backlight control value.

In an embodiment of the present disclosure, the statistical value is an average value. Of course, the statistical value can further be a maximum value or a median value, which is not limited in the present disclosure.

In an embodiment of the present disclosure, for each image segment of the first image, the following calculation formula (1) may be used to obtain an average value of the pixel values of all pixels in the image segment may be obtained through the following equation (1).

$$L_{average} = \frac{\sum_{k}^{N}\sum_{f}^{M} I(k, f)}{M * N} \tag{1}$$

where, Laverage is an average value of the pixel values of all pixels in an image segment, I(k, f) is a pixel value of the pixel in the k-th row and the f-th column in the image segment, and N is the number of pixels in the k-th row in the image segment, M is the number of pixels in the f-th column in the image segment.

In an embodiment of the present disclosure, the pixel value of each pixel is (R, G, B), wherein I(k, f) may be a maximum value among the pixel values R, G, B of the pixel at the k-th row and the f-th column. For example, in a case that the R value is the largest, I(k, f) may be the R value. Of course, I(k, f) may further be an average value or a median value of the pixel values R, G, and B of the pixel at the k-th row and the f-th column.

In an embodiment of the present disclosure, by normalizing the average value of the pixel values of all pixels in the image segment, the initial backlight control value of the dimming zone corresponding to the image segment may be obtained. Taking a 10 bit image processing system as an example, the average value of the pixel values needs to be normalized to a numerical range of 0000~ffff (hexadecimal), and may be calculated according to the following equation (2):

$$L_{control} = \frac{L_{average}}{1023} \cdot \text{hex}(ffff) \tag{2}$$

where, $L_{control}$ is the initial backlight control value, 1023 is the maximum color scale, hex(ffff) is the maximum range.

In an embodiment of the present disclosure, the initial backlight control data is obtained by calculating the initial backlight control values of all dimming zones.

In step S504, a start flag of a second image is detected, wherein the first image and the second image are two adjacent images in a video, and the first image is displayed before the second image.

In an embodiment of the present disclosure, after obtaining the initial backlight control data according to the image data of the first image, the initial backlight control data may be stored in a memory and a start flag of the second image is detected. After the start flag of the second image is detected, step S505 is performed. The memory may be an RAM (Random Access Memory), which is not limited in the present disclosure.

In step S505, smoothing-filtering is performed on the initial backlight control data with the target filter core to obtain target backlight control data, wherein the target backlight control data includes respective target backlight control values of the plurality of dimming zones.

In an embodiment of the present disclosure, in the process of performing smoothing-filtering on the initial backlight control data with the target filter core, a plurality of smoothing-filtering operations may be performed, and a corresponding window data may be read from the initial backlight control data after each smoothing-filtering, and corresponding backlight control data may be obtained by calculating the window data.

Figures 10, 11, 12:
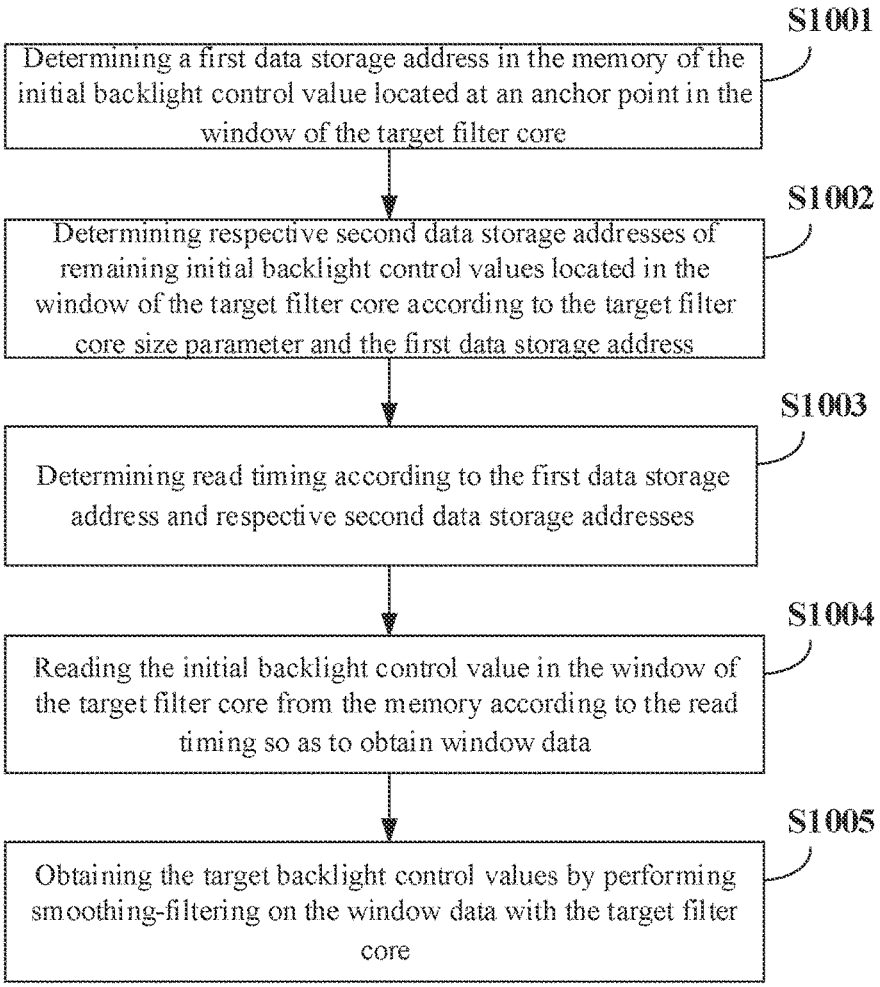
FIG. 10 illustrates a flowchart of a method of controlling backlight brightness of a display device according to still another embodiment of the present disclosure.
FIG. 11 illustrates a schematic diagram of initial backlight control data according to an embodiment of the present disclosure.
FIG. 12 illustrates a schematic diagram of initial backlight control data according to another embodiment of the present disclosure.

In an embodiment of the present disclosure, as illustrated in FIG. 10, step S505 may include the following steps S1001 to S1005:

In step S1001, a first data storage address in the memory of the initial backlight control value located at an anchor point in the window of the target filter core is determined.

In an embodiment of the present disclosure, the plurality of dimming zones 111 includes dimming zones 111 of n rows and m columns. As illustrated in FIG. 11, the initial backlight control data includes an initial backlight control value array of n rows and m columns. As illustrated in FIG. 12, the initial backlight control data are spreaded in a one-dimensional storage space of the memory. Therefore, before obtaining the window data, it is necessary to obtain storage addresses of each initial backlight control value in the window.

In an embodiment of the present disclosure, for each smoothing-filtering, a first data storage address in the memory of the initial backlight control value located at an anchor point of the window of the target filter core is first determined. In a case of calculating a target backlight control value of the i-th row and the j-th column, a position of the initial backlight control value in the i-th row and the j-th column is the anchor point position of the window of the target filter core.

In an embodiment of the present disclosure, as illustrated in FIG. 8, in a case that a size of the target filter core is an odd number, for example, the size of the target filter core being 5*5, an anchor point of the window of the target filter core is located at the center of the window, that is, a position of Data0. For example, in a case of calculating a target backlight control value of the first row and the first column, the anchor point of the window of the target filter core is located at a position of the initial backlight control value of the first row and the first column, and in a case of calculating a target backlight control value of the third row and the third column, the anchor point of the window of the target filter core is located at a position of the initial backlight control value of the third row and third column.

In an embodiment of the present disclosure, as illustrated in FIG. 13, in a case that a size of the target filter core is an even number, for example, the size of the target filter core is 2*2, and the anchor point position of the window of the target filter core is located at a starting position of the window, that is, a position of Data0. It should be noted that values of the coefficients of the window illustrated in FIG. 8 and values of the coefficients of the window illustrated in FIG. 13 may be different. For example, Data1 of FIG. 8 may be different from Data1 of FIG. 13.

In step S1002, respective second data storage addresses of remaining initial backlight control values located in the window of the target filter core are determined according to the target filter core size parameter and the first data storage address.

In an embodiment of the present disclosure, for each smoothing-filtering, in a case that the size of the target filter core is an odd number, the respective second data storage addresses of the remaining initial backlight control values in the window of the filter core are determined according to the following equation (3) based on the target filter core size parameter and the first data storage address:

$$r_addr_window = r_addr_base + j + step * i \quad (3)$$

Where, r_addr_window is the second data storage address, r_addr_base is the first data storage address, the i is a row flag of an initial backlight control value array, the j is the column flag of the initial backlight control value array, and the step is the number of initial backlight control values of each row in the initial backlight control value array, a value range of the i is [−(w−1)/2, (w−1)/2], a value range of the j is [−(w−1)/2, (w−1)/2], the w is the target filter core size parameter.

For example, in a case that w is 5 and the target backlight control value of row 3 and column 3 is calculated, the anchor point of the window of the target filter core is located at the position of the initial backlight control value D33 of row 3 and column 3. The remaining initial backlight control values in the window are D11~D15, D21~D25, D31~D32, D34~D35, D41~D45 and D51~D55. The storage address of the initial backlight control value D33 is the first data storage address, and the storage addresses of the initial backlight control values D11 to D15, D21 to D25, D31 to D32, D34 to D35, and D41 to D45 are the second data storage addresses.

In an embodiment of the present disclosure, for each smoothing-filtering, in a case that the size of the target filter core is an even number, respective second data storage addresses of the remaining initial backlight control values in the window of the filter core are determined according to the following equation (4) based on the target filter core size parameter and the first data storage address:

$$r_addr_window = r_addr_base + j + step * i \quad (4)$$

where, a value range of the i is [0, w−1], a value range of the j is [0, w−1], and the w is the target filter core size parameter.

For example, in a case that w is 2 and the target backlight control value of the first row and the first column is calculated, the anchor point of the window of the target filter core is located at a position of the initial backlight control value D11 of the first row and the first column, and the remaining initial backlight control values are D12, D21, and D22. The storage address of the initial backlight control value D11 is the first data storage address, and the storage addresses of the initial backlight control values D12, D21, and D22 are the second data storage addresses.

In step S1003, read timing is determined according to the first data storage address and respective second data storage addresses.

In an embodiment of the present disclosure, for each smoothing-filtering, after obtaining the respective data storage addresses of the initial backlight control values in the window of the target filter core, the read timing is determined according to the first data storage address and the respective second data storage addresses so as to read window data from the memory.

In step S1004, the initial backlight control value in the window of the target filter core is read from the memory according to the read timing so as to obtain window data.

In an embodiment of the present disclosure, in a case that the w is 5 and the target backlight control value of the third row and the third column is calculated, D11 to D55 may be read from the memory according to the read timing so as to obtain the window data. In a case that the w is 2 and the target backlight control value of the first row and the first column is calculated, D11~D22 may be read from the memory according to the read timing so as to obtain the window data.

In step S1005, the target backlight control values are obtained by performing smoothing-filtering on the window data with the target filter core.

In an embodiment of the present disclosure, after obtaining the window data, the target backlight control value may be obtained by performing smoothing-filtering on the window data with the target filter core. For example, in a case that the w is 5 and the target backlight control value of the third row and third column is calculated, the target backlight control value d33 may be obtained by performing smoothing-filtering on D11~D55 with the target filter core as illustrated in FIG. 8. After performing smoothing-filtering on the initial backlight control data with the target filter core, target backlight control data as illustrated in FIG. 14 may be obtained, and the target backlight control data includes respective target backlight control value d11~dnm of a plurality of dimming zones 111.

In an embodiment of the present disclosure, steps S501 to S505 may be performed by a Field Programmable Gate Array (FPGA), and the RAM is provided in the FPGA. In an embodiment of the present disclosure, a buffer type of the FPGA may be a Line-buffer, and in a case that design of the line buffer is determined, implementation of filtering is determined.

In step S506, backlight brightness of a corresponding dimming zone is controlled according to the target backlight control value.

In an embodiment of the present disclosure, a driving chip for the backlight module may control backlight brightness of a corresponding dimming zone according to the target backlight control value. For example, the driving chip may control backlight brightness of the dimming zone of the first row and the first column according to d11, the driving chip may control backlight brightness of the dimming zone of the first row and the second column according to d12, . . . , and the driving chip may control backlight brightness of the dimming zone of the n-the row and the m-th column according to dnm. That is, the driving chip may control the backlight module to emit light according to the target backlight control data.

In an embodiment of the present disclosure, the target image display mode may be determined according to the first selection information input by the user, and options corresponding to at least two filter core sizes corresponding to the target image display mode are provided for the user to select the filter core size, such that a suitable filter core size can be determined according to the second selection information input by the user, thereby avoiding non-uniform backlight intensity distribution or heavier halo near objects in the display screen, which is beneficial to improve the display effect.

In the embodiments of the present disclosure, the user is provided with a choice of filter core size, such that poor adaptability to pictures of different styles in a case of a filter core with fixed size is mitigated.

At least one embodiment of the present disclosure further provides a method of controlling backlight brightness for a display device. Difference between this embodiment and the foregoing embodiment is that, in this embodiment, as illustrated in FIG. 15, step S501 includes the following steps S1501 to S1502:

In step S1501, a target filter core size parameter is determined according to the target image display mode and a third correspondence, and the third correspondence indicates a correspondence between the image display mode and the filter core size parameter.

In step S1502, the target filter core is determined according to the target filter core size parameter and the second correspondence, and the second correspondence indicates a correspondence between the filter core size parameter and a filter core.

In an embodiment of the present disclosure, a third correspondence may be stored in the display device in advance. After the target image display mode is determined, the display device may look up the third correspondence according to the target image display mode to obtain a corresponding target filter core size parameter. For example, the third correspondence relationship may be as illustrated in Table 1 below, which is not limited in the present disclosure. In a case that it is determined that the target image display mode is the character mode, Table 1 may be looked up according to the character mode, and it is determined that the target filter core size parameter is 3.

TABLE 1

| Display mode | Filter core size parameter |
|---|---|
| Character mode | 3 |
| Delicacy mode | 6 |
| Landscape mode | 9 |

In an embodiment of the present disclosure, the second correspondence may be stored in the display device in advance. After determining the target filter core size parameter, the display device may determine a corresponding target filter core by looking up the second correspondence according to the target filter core size parameter. For example, in a case that the target filter core size parameter is 3, the second correspondence may be looked up according to the target filter core size parameter to determine that the corresponding target filter core is a 3*3 filter core.

In an embodiment of the present disclosure, the target filter core size parameter can be determined according to the target image display mode, and the corresponding target filter core can be determined according to the target filter core size parameter, so that the filter core size can be determined according to the image display mode and non-uniform backlight intensity distribution or relatively heavy halos near objects in the display screen can be avoided, thereby improving the display effect.

The embodiment of the present disclosure further provides a method of controlling backlight brightness for a display device. Difference between this embodiment and the foregoing embodiments is that, in this embodiment, as illustrated in FIG. 16, step S501 includes the following steps S1601 to S1602:

In step S1601, target image content is obtained by performing image processing on the first image.

In step S1602, a target image display mode is determined according to the target image content and a first correspondence, wherein the first correspondence indicates the correspondence between image content and the image display mode.

In an embodiment of the present disclosure, the display device may perform image processing, such as image recognition, on the first image, to obtain the target image content. The image content may be a person, delicacy, or landscape. For example, in a case that the first image is a person image, a result of performing image recognition on the first image is that the target image content is a person. Therefore, it is determined that the target image display mode is the character mode according to the first correspondence.

In an embodiment of the present disclosure, an algorithm for performing image recognition on the first image may be a related mature algorithm, which will not be elaborated here.

In an embodiment of the present disclosure, the first correspondence is stored in the display device in advance. After the image content of the first image is recognized, the display device can look up the first correspondence according to the target image content to determine the target image display mode. For example, the first correspondence may be as illustrated in Table 2 below, but is not limited to this.

In an embodiment of the present disclosure, in a case that it is recognized that the image content is a person, it can be determined that the target image display mode is the character mode by looking up Table 2 according to the person.

In an embodiment of the present disclosure, the display device can automatically perform image recognition on the image content of the image, and determine the corresponding image display mode according to the recognized image content, so as to determine the corresponding filter core size according to the image display mode. Thus, non-uniform backlight intensity distribution or a relatively heavy halo may be avoided, thereby improving the display effect and having a high degree of automation.

TABLE 2

| Display mode | Image display mode |
|---|---|
| Character | Character mode |
| Delicacy | Delicacy mode |
| Landscape | Landscape mode |

Figure 17:
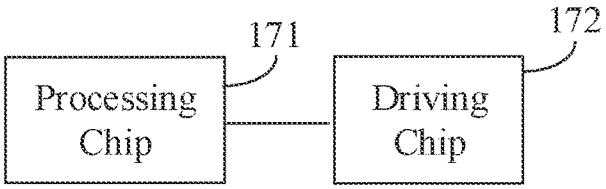
FIG. 17 illustrates a schematic structural view of a device for controlling backlight brightness of a display device according to an embodiment of the present disclosure.

At least one embodiment of the present disclosure further provides a device for controlling backlight brightness for a display device. The display device includes a backlight module, and the backlight module includes a plurality of dimming zones. As illustrated in FIG. 17, the device for controlling backlight brightness includes a processing chip 171 and a driving chip 172;

the processing chip 171 is configured to: determine a target image display mode, determine a corresponding target filter core according to the target image display mode, and obtain initial backlight control values of corresponding dimming zones according to image data of a plurality of image segments of a first image, so as to obtain initial backlight control data, wherein the plurality of image segments correspond to the plurality of dimming zones in a one-to-one correspondence, and obtain target backlight control data by performing smoothing-filtering on the initial backlight control data with the target filter core, wherein the target backlight control data includes respective target backlight control values of the plurality of dimming zones;

The driving chip 172 is configured to control respective backlight brightness of the plurality of dimming zones according to the respective target backlight control values.

In an embodiment of the present disclosure, the backlight brightness control device may include at least one processing chip 171 configured to determine a target image display mode, and determine a corresponding target filter core according to the target image display mode, obtain initial backlight control data by acquiring an initial backlight control value of a corresponding dimming zone according to image data of a plurality of image segments of a first image, the plurality of image segments corresponding to the plurality of dimming zones in a one-to-one correspondence, and obtain target backlight control data by performing smoothing-filtering on the initial backlight control data with the target filter core, wherein the target backlight control data includes respective target control values of the plurality of dimming zones.

For example, there may be two processing chips 171, and the two processing chips 171 cooperate with each other to implement the following operations: determining a target image display mode, determining a corresponding target filter core according to the target image display mode, and obtaining initial backlight control data by acquiring initial backlight control values of a corresponding dimming zone according to image data of a plurality of image segments of a first image, wherein the plurality of image segments correspond to the plurality of dimming zones in a one-to-one correspondence, and obtaining target backlight control data by performing smoothing-filtering on the initial backlight control data with the target filter core, wherein the target backlight control data include respective target backlight control value of the plurality of dimming zones.

In an embodiment of the present disclosure, before the processing chip 171 is configured to obtain the target backlight control data by performing smoothing-filtering on the initial backlight control data with the target filter core, the processing chip 171 is further configured to detect a start flag of a second image; wherein the first image and the second image are two adjacent images in a same video, and the first image is displayed before the second image.

Figure 18:
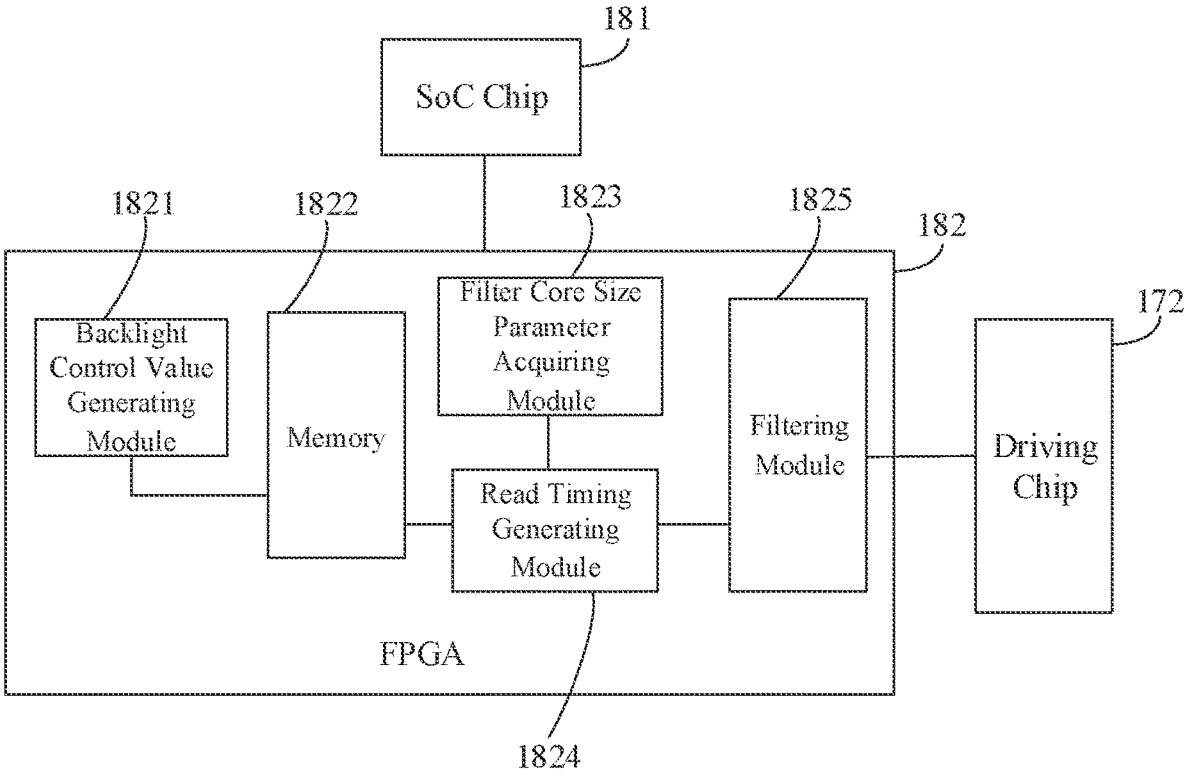
FIG. 18 illustrates a schematic structural view of a device for controlling backlight brightness of a display device according to another embodiment of the present disclosure.

At least one embodiment of the present disclosure further provides a device for controlling backlight brightness for a display device. The display device includes a backlight module, and the backlight module includes a plurality of dimming zones. As illustrated in FIG. 18, the device for controlling backlight brightness includes a System-on-Chip (SoC) 181, a field programmable logic gate array (FPGA) 182 and a driving chip 172.

The SoC 181 is configured to determine a target image display mode. The SoC 181 may be referred to as a system-level chip.

In an embodiment of the present disclosure, the SoC 181 is configured to receive first selection information and determine a target image display mode according to the first selection information; the first selection information indicates the target image display mode selected from at least two image display mode.

In another embodiment of the present disclosure, the SoC 181 is configured to perform image recognition on the first image to obtain target image content, and determine the target image display mode according to the target image content and a first correspondence, and the first correspondence indicates a correspondence between image content and an image display mode.

In an embodiment of the present disclosure, the SoC 181 is configured to receive second selection information after determining the target image display mode, and determine a target filter core size parameter according to the second selection information and output the target filter core size parameter to the FPGA 182; the second selection information includes the target filter core size parameter selected from at least two filter core size parameters corresponding to the target image display mode.

In another embodiment of the present disclosure, the SoC 181 is configured to determine the target filter core size parameter according to the target image display mode and a third correspondence after determining the target image display mode, and to output the target filter core size parameter to the FPGA 182, wherein the third correspondence indicates a correspondence between the image display mode and the filter core size parameter.

In an embodiment of the present disclosure, the FPGA 182 is configured to determine a target filter core according to the target filter core size parameter and a second correspondence, wherein the second correspondence indicates a correspondence between the filter core size parameter and the filter core.

In an embodiment of the present disclosure, as illustrated in FIG. 18, the FPGA 182 includes a filter core size parameter acquiring module 1823, and the filter core size parameter acquiring module 1823 is configured to acquire the target filter core size parameter from the SoC 181.

In an embodiment of the present disclosure, the FPGA 182 is configured to obtain, for each image segment, a statistical value of pixel values of all pixels in the image segment, and normalize the statistical value to obtain the initial backlight control value.

In an embodiment of the present disclosure, as illustrated in FIG. 18, the FPGA 182 includes a backlight control value generating module 1821, and the backlight control value generating module 1821 is configured to obtain initial backlight control data by acquiring initial backlight control value of a corresponding dimming zone according to respective image data of a plurality of image segments of a first image.

In an embodiment of the present disclosure, as illustrated in FIG. 18, the FPGA 182 includes a memory 1822. The memory 1822 may be an RAM. The FPGA 182 is configured to store the initial backlight control data in the memory 1822, and for each smoothing-filtering, determine a first data storage address in the memory 1822 of an initial backlight control value located at an anchor position in a window of the target filter core, determine respective second data storage addresses of remaining initial backlight control values in the window of the target filter core according to the target filter core size parameter and the first data storage address, and determine a read timing according to the first data storage address and the respective second data storage addresses, obtain window data by reading the initial backlight control values in the window of the target filter core from the memory according to the read timing, and obtain the target backlight control value by performing smoothing-filtering on the window data with the target filter core.

In an embodiment of the present disclosure, as illustrated in FIG. 18, the FPGA 182 includes a read timing generating module 1824 and a filtering module 1825. The read timing generating module 1824 is configured to determine a read timing of the window data of the target filter core for each smoothing-filtering, and read the window data from the memory 1822 according to the read timing; and the filtering module 1825 is configured to obtain the target backlight control values by performing smoothing-filtering on the window data with the target filter core.

The driving chip 172 is configured to control backlight brightness of corresponding dimming zones according to the target backlight control values.

In the embodiments of the present disclosure, by determining the target image display mode, the corresponding target filter core is determined according to the target image display mode, and the target backlight control data is obtained by performing smoothing-filtering on the initial backlight control data with the target filter core, and the backlight intensity of the respective dimming zones are controlled according to the target backlight control values. That is, by determining the target image display mode, the filter core that performs smoothing-filtering on the initial backlight control data can be controlled, so that the target filter core may be selected according to the actual situation of the image to be displayed, so as to avoid non-uniform backlight intensity distribution or relatively heavy halos near objects in the display screen, thereby improving the display effect.

At least one embodiment of the present disclosure further provides an apparatus for controlling backlight brightness for a display device, the apparatus for controlling backlight brightness includes: a processor, and a storage medium, the storage medium is configured to store computer instructions executable by the processor, wherein, in response to that the computer instructions are executed by the processor, the processor is configured to implement operations of the method of controlling backlight brightness for a display device according to any one of the foregoing embodiments.

Figure 19:
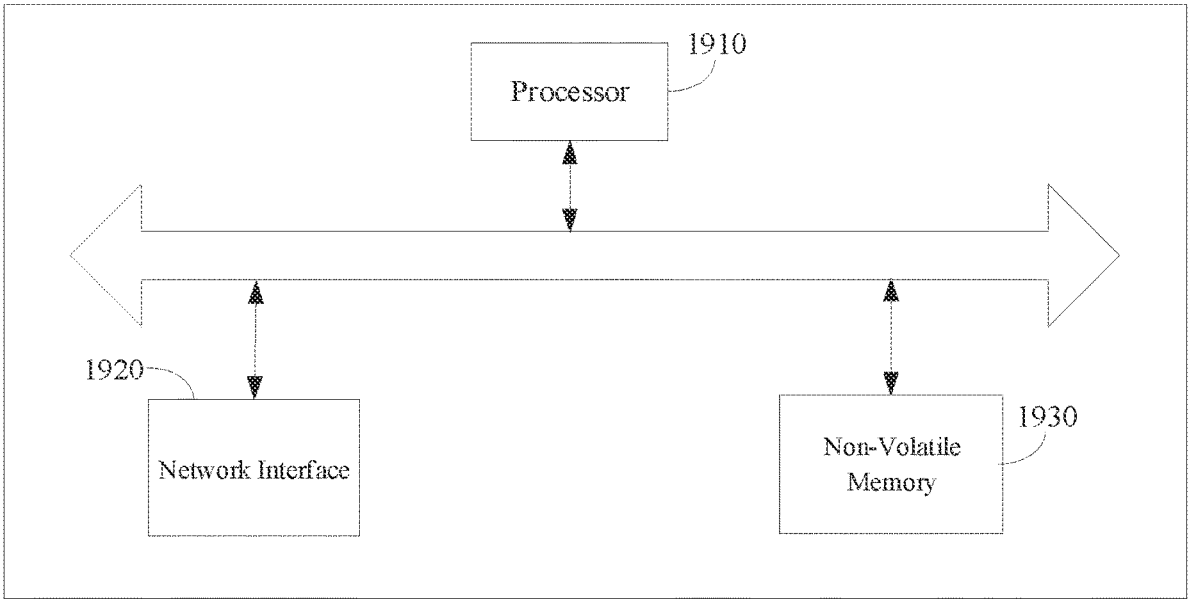
FIG. 19 illustrates a schematic structural view of a device for controlling backlight brightness of a display device according to still another embodiment of the present disclosure.

In an embodiment of the present disclosure, the apparatus for controlling backlight brightness may be as illustrated in FIG. 19. FIG. 19 illustrates a hardware structure view of an apparatus for controlling backlight brightness according to an embodiment of the present disclosure. In addition to a processor 1910, a network interface 1920, and a non-volatile memory 1930 illustrated in FIG. 19, the apparatus for controlling backlight according to this embodiment further includes other hardware according to its actual function, which will not be elaborated herein.

At least one embodiment of the present disclosure further provides a storage medium in which computer instructions executable by a processor are stored, and in response to the computer instructions are executed by the processor, the processor is configured to implement operations of the method of controlling backlight brightness for the display device as described in any one of the above embodiments.

At least one embodiment of the present disclosure further provides a display device, including a backlight module and an apparatus for controlling backlight brightness, the backlight module includes a plurality of dimming zones, and the apparatus for controlling backlight brightness is the apparatus for controlling backlight brightness according to any one of the foregoing embodiments.

It should be noted that the display device according to the embodiments of the present disclosure may be any product or component with display function such as electronic paper, mobile phones, tablet computers, televisions, notebook computers, digital photo frames, navigators, etc.

It should be pointed out that in the drawings, sizes of layers and regions may be exaggerated for clarity of illustration. It should be understood that when an element or layer is referred to as being "on" another element or layer, it can be directly on the other element or intervening layers may be present. In addition, it should be understood that when an element or layer is referred to as being "under" another element or layer, it can be directly under the other element, or there may be more than one intervening layer or element. In addition, it can also be understood that when a layer or element is referred to as being "between" two layers or two elements, it can be the only layer between the two layers or two elements, or more than one intervening layer or component may be present. Similar reference numerals designate similar elements throughout.

In the present disclosure, the terms "first" and "second" are only used for the purpose of description, and cannot be understood as indicating or implying relative importance. The term "plurality" refers to two or more, unless specifically defined otherwise.

One of ordinary skill in the art will easily think of other embodiments of the present disclosure after considering the specification and practicing the disclosure disclosed herein. The present disclosure is intended to cover any variations, application, or adaptive modification of the present disclosure. These variations, uses, or adaptive modification follow the general principles of the present disclosure and include common knowledge or conventional technical means in the art that are not disclosed in the present disclosure. The description and the embodiments are to be regarded as exemplary only, and the true scope and spirit of the present disclosure are defined by the appended claims.

The invention claimed is:

1. A method of controlling backlight brightness, applicable to a display device which comprises a backlight module having a plurality of dimming zones, wherein the method comprises:

determining a target image display mode;

determining a target filter core according to the target image display mode;

obtaining initial backlight control data by acquiring initial backlight control values of respective dimming zones according to image data of respective image segments of a first image, wherein the respective image segments correspond to the respective dimming zones in a one-to-one correspondence;

obtaining target backlight control data by performing smoothing-filtering on the initial backlight control data with the target filter core, wherein the target backlight control data comprises respective target backlight control values of the plurality of dimming zones; and controlling backlight brightness of the respective dimming zones according to the respective target backlight control values;

wherein determining the target filter core according to the target image display mode comprises:

receiving a second selection information, wherein the selection information indicates a target filter core size parameter selected from at least two filter core size parameters corresponding to the target image display mode;

determining the target filter core size parameter according to the second selection information; and determining the target filter core according to the target filter core size parameter and a second correspondence, wherein the second correspondence indicates a correspondence between a filter core size parameter and a filter core.

2. The method according to claim 1, wherein determining the target image display mode comprises:

receiving first selection information, wherein the first selection information indicates a target image display mode selected from at least two image display modes; and determining the target image display mode according to the first selection information.

3. The method according to claim 1, wherein determining the target image display mode comprises:

obtaining target image content by performing image recognition on the first image;

determining the target image display mode according to the target image content and a first correspondence, wherein the first correspondence indicates a correspondence between image content and an image display mode.

4. The method according to claim 1, wherein obtaining the initial backlight control data by acquiring the initial backlight control values of the respective dimming zones according to the image data of the respective image segments of the first image comprises:

for each of the image segments, acquiring a statistical value of pixel values of all pixels in the image segment; and normalizing the statistical value to obtain the initial backlight control value.

5. The method according to claim 1, wherein after obtaining the initial backlight control data by acquiring the initial backlight control values of the respective dimming zones according to the image data of the respective image segments of the first image, the method further comprises storing the initial backlight control data in a memory;

obtaining the target backlight control data by performing smoothing-filtering on the initial backlight control data with the target filter core comprises:

for each smoothing-filtering, determine a first data storage address in the memory of the initial backlight control value located at an anchor point in a window of the target filter core;

determining respective second data storage addresses of remaining initial backlight control values in the window of the target filter core according to the target filter core size parameter and the first data storage address;

determining a read timing according to the first data storage address and the respective second data storage addresses;

reading the initial backlight control value in the window of the target filter core from the memory according to the read timing so as to obtain window data; and obtaining the target backlight control values by performing smoothing-filtering on the window data with the target filter core.

6. The method according to claim 5, wherein the target filter core size parameter is an odd number; the anchor point is a center point of the window; the plurality of dimming zones comprises dimming zones of n rows and m columns, the initial backlight control data comprises an initial backlight control value array of n rows and m columns; respective second data storage addresses in the target filter core window of the remaining initial backlight control values are determined according to following equation and according to the target filter core size parameter and the first data storage address:

$$r_addr_window = r_addr_base + j + step * i$$

wherein, the r_addr_window indicates the second data storage address, the r_addr_base indicates the first data storage address, the i indicates a row flag of the initial backlight control value array, and the j indicates a column flag of the initial backlight control value array, the step indicates the number of initial backlight control values in each row in the initial backlight control value array, and a value range of the i is $[-(w-1)/2, (w-1)/2]$, a value range of the j is $[-(w-1)/2, (w-1)/2]$, and the w indicates the target filter core size parameter.

7. The method according to claim 5, wherein the target filter core size parameter is an even number; the anchor point is a start point of the window; and the plurality of dimming zones comprises dimming zones of n rows and m columns, the initial backlight control data comprises an initial backlight control value array of n rows and m columns; according to the target filter core size parameter and the first data storage address, respective second data storage addresses in the target filter core window of the remaining initial backlight control values are determined according to following equation and according to the target filter core size parameter and the first data storage address:

$$r_addr_window = r_addr_base + j + step * i$$

wherein, the r_addr_window indicates the second data storage address, the r_addr_base indicates the first data storage address, the i indicates a row flag of the initial backlight control value array, and the j indicates a column flag of the initial backlight control value array, the step indicates the number of initial backlight control values in each row in the initial backlight control value array, a value range of the i is $[0, w-1]$, a value range of the j is $[0, w-1]$, and the w indicates the target filter core size parameter.

8. The method according to claim 1, wherein, before obtaining the target backlight control data by performing smoothing-filtering on the initial backlight control data with the target filter core, the method further comprises:

detecting a start flag of a second image, wherein the first image and the second image are two adjacent images in the same video, and the first image is displayed before the second image.

9. A backlight brightness control apparatus, applicable to a display device, the display device comprising a backlight module, the backlight module comprising a plurality of dimming zones, wherein the backlight brightness control apparatus comprises: a processor and a storage medium, the storage medium is configured to store computer instructions suitable executable by the processor, wherein in response to that the computer instructions are executed by the processor, the processor is configured to implement operations of the method of controlling backlight brightness for the display device according to claim 1.

10. A method of controlling backlight brightness, applicable to a display device which comprises a backlight module having a plurality of dimming zones, wherein the method comprises:

determining a target image display mode;

determining a target filter core according to the target image display mode;

obtaining initial backlight control data by acquiring initial backlight control values of respective dimming zones according to image data of respective image segments of a first image, wherein the respective image segments correspond to the respective dimming zones in a one-to-one correspondence;

obtaining target backlight control data by performing smoothing-filtering on the initial backlight control data with the target filter core, wherein the target backlight control data comprises respective target backlight control values of the plurality of dimming zones; and controlling backlight brightness of the respective dimming zones according to the respective target backlight control values;

wherein determining the corresponding target filter core according to the target image display mode comprises:

determining the target filter core size parameter according to the target image display mode and a third correspondence, wherein the third correspondence indicates a correspondence between an image display mode and a filter core size parameter; and determining the target filter core according to the target filter core size parameter and a second correspondence, wherein the second correspondence indicates a correspondence between a filter core size parameter and a filter core.

11. A backlight brightness control device, applicable to a display device, the display device comprising a backlight module, the backlight module comprising a plurality of dimming zones, wherein the backlight brightness control device comprises: a processor and a storage medium, the storage medium is configured to store computer instructions suitable executable by the processor, wherein in response to that the computer instructions are executed by the processor, the processor is configured to implement operations of the method of controlling backlight brightness for the display device according to claim 10.

12. A backlight brightness control device applicable to a display device, the display device comprising a backlight module, the backlight module comprising a plurality of dimming zones, wherein the backlight brightness control device comprises a processing chip and a driving chip;

the processing chip is configured to: determine a target image display mode; determine a target filter core according to the target image display mode; obtain initial backlight control data by acquiring initial backlight control values of respective dimming zones according to image data of respective image segments of a first image, wherein the respective image segments correspond to the respective dimming zones in a one-to-one correspondence; obtain target backlight control data by performing smoothing-filtering on the initial backlight control data with the target filter core, wherein the target backlight control data comprises respective target backlight control values of the plurality of dimming zones; and the driving chip is configured to control the backlight brightness of the respective dimming zones according to the target backlight control values;

the processing chip comprises an SoC chip and an FPGA, wherein the SoC chip is configured to receive second selection information and to determine a target filter core size parameter according to the second selection information, wherein the second selection information indicates a target filter core size parameter selected from at least two filter core size parameter corresponding to the target image display mode; and the FPGA is configured to determine the target filter core according to the target filter core size parameter and a second correspondence, wherein the second correspondence indicates a correspondence between a filter core size parameter and a filter core.

13. The backlight brightness control device according to claim 12, wherein the SoC chip is configured to receive first selection information and to determine the target image display mode according to the first selection information, the first selection information indicating a target image display mode selected from at least two image display modes.

14. The backlight brightness control device according to claim 12, wherein the SoC chip is configured to perform image recognition on the first image to obtain target image content, and to determine the target image display mode according to the target image content and a first correspondence, the first correspondence indicating a correspondence between an image content and an image display mode.

15. The backlight brightness control device according to claim 12, wherein the SoC chip is configured to determine a target filter core size parameter according to the target image display mode and a third correspondence, wherein the third correspondence indicates a correspondence between an image display mode and a filter core size parameter; and the FPGA is configured to determine the target filter core according to the target filter core size parameter and the second correspondence, wherein the second correspondence indicates a correspondence between the filter core size parameter and a filter core.

16. The backlight brightness control device according to claim 12, wherein the FPGA is configured to obtain, for each of the plurality of image segments, a statistical value of pixel values of all pixels in the image segment, and to obtain the initial backlight control values by normalizing the statistical value.

17. The backlight brightness control device according to claim 12, wherein the FPGA comprises a memory; and the FPGA is configured to store the initial backlight control data in the memory; and for each smoothing-filtering, determine a first data storage address in the memory of the initial backlight control value located at an anchor point in the window of the target filter core; determine respective second data storage addresses of remaining initial backlight control values in the window of the target filter core according to the target filter core size parameter and the first data storage address; determine a read timing according to the first data storage address and the respective second data storage addresses; obtain window data by reading the initial backlight control value in the window of the target filter core from the memory according to the read timing; and obtain the target backlight control values by performing smoothing-filtering on the window data with the target filter core.

18. The backlight brightness control device according to claim 12, wherein the processing chip is further configured to, before obtaining the target backlight control data by performing smoothing-filtering on the initial backlight control data with the target filter core, detect a start flag of a second image, wherein the first image and the second image are two adjacent images of a same video, and the first image is displayed before the second image.

19. A display device, comprising a backlight module and the backlight brightness control device of the display device according to claim 12, wherein the backlight module comprises a plurality of dimming zones.

* * * * *